US007807039B2

(12) United States Patent
Piesslinger-Schweiger et al.

(10) Patent No.: US 7,807,039 B2
(45) Date of Patent: Oct. 5, 2010

(54) ELECTROLYTE FOR ELECTROCHEMICALLY POLISHING METALLIC SURFACES

(75) Inventors: Siegfried Piesslinger-Schweiger, Vaterstetten (DE); Razmik Abedian, Oberhaching (DE); Olaf Böhme, Erding (DE)

(73) Assignee: Poligrat-Holding GmbH, Munich (DE)

( * ) Notice: Subject to any disclaimer, the term of this patent is extended or adjusted under 35 U.S.C. 154(b) by 1050 days.

(21) Appl. No.: 10/556,291

(22) PCT Filed: Apr. 30, 2004

(86) PCT No.: PCT/EP2004/004600

§ 371 (c)(1),
(2), (4) Date: Sep. 20, 2006

(87) PCT Pub. No.: WO2004/100283

PCT Pub. Date: Nov. 18, 2004

(65) Prior Publication Data

US 2007/0029209 A1 Feb. 8, 2007

(30) Foreign Application Priority Data

May 9, 2003 (DE) ..... 103 20 909

(51) Int. Cl.
*C25F 3/22* (2006.01)
*C25F 3/26* (2006.01)

(52) U.S. Cl. ..... 205/678; 205/675

(58) Field of Classification Search ..... 205/678, 205/675

See application file for complete search history.

(56) References Cited

U.S. PATENT DOCUMENTS

| | | | | |
|---|---|---|---|---|
| 2,863,811 | A | 12/1958 | Ruscetta et al. | |
| 3,974,280 | A * | 8/1976 | Bernasconi | 514/324 |
| 4,563,257 | A * | 1/1986 | Sova | 205/661 |
| 5,861,535 | A * | 1/1999 | Mylroie | 564/397 |
| 6,352,636 | B1 * | 3/2002 | Wei et al. | 205/717 |
| 6,447,664 | B1 | 9/2002 | Taskovics et al. | |
| 6,610,194 | B1 | 8/2003 | Guerin | |
| 7,357,854 | B1 * | 4/2008 | Andreacchi | 205/674 |
| 2002/0019128 | A1 | 2/2002 | Lee et al. | |
| 2003/0178320 | A1 * | 9/2003 | Liu et al. | 205/640 |

FOREIGN PATENT DOCUMENTS

| | | |
|---|---|---|
| EP | 1 094 134 A1 | 4/2001 |
| FR | 2 795 433 A1 | 12/2000 |

* cited by examiner

*Primary Examiner*—Alexa D. Neckel
*Assistant Examiner*—Nicholas A. Smith
(74) *Attorney, Agent, or Firm*—Crowell & Moring LLP

(57) ABSTRACT

The present invention relates to electrolytes for electrochemically polishing workpieces consisting of titanium, titanium alloys, niobium, niobium alloys, tantalum and tantalum alloys, which electrolytes contain sulfuric acid, ammonium bifluoride and at least one hydroxycarboxylic acid, and a method for electrochemical polishing.

10 Claims, No Drawings

ELECTROLYTE FOR ELECTROCHEMICALLY POLISHING METALLIC SURFACES

The present invention relates to electrolytes for electrochemically polishing workpieces consisting of titanium, titanium alloys, niobium, niobium alloys, tantalum and tantalum alloys, and a method for electrochemical polishing.

The electrochemical polishing or brightening of metallic surfaces is widely used in industry for the treatment of smaller and larger metal articles. Owing to the greatly increasing use of titanium and titanium alloys in the area of apparatus construction, vehicle construction, aircraft construction or medical technology, the surface processing of these materials by electropolishing is becoming increasingly important. In electropolishing, the articles to be polished, which hang from appropriate support elements or are arranged in baskets or the like, are lowered into the electrolyte, i.e. the polishing bath, and are raised out of it after a certain polishing time. After the bath liquid has flowed off the polished surfaces, the articles are immersed in wash baths in order to remove the electrolyte.

According to the prior art today, either electrolytes comprising mixtures of perchloric acid/acetic anhydride or mixtures of hydrofluoric acid/sulfuric acid/acetic acid or hydrofluoric acid/sulfuric acid/acetic anhydride or sulfuric acid/hydrofluoric acid/phosphoric acid/ethylene glycol (FR 2 795 433) are used for the treatment of titanium and titanium alloys.

Although these electrolytes are capable of achieving satisfactory electropolishing results on pure titanium and a limited selection of titanium alloys, the electrolyte according to Patent FR 2 795 433 is not suitable for electropolishing titanium-nickel alloys, such as nitinol, which is becoming increasingly important as a memory alloy, with sufficient surface quality. The use of these two types of electrolytes has some disadvantages which prevent use on an industrial scale:

Although electrolytes consisting of mixtures of perchloric acid/acetic anhydride have long been known and give good electropolishing results, their use is subject to very narrow limits owing to the associated high risk of explosion. In addition, the use of electrolytes which contain acetic acid is associated with a considerable odor annoyance, which requires correspondingly complicated air extraction at the workplace with complicated waste air treatment. Electrolytes which, as described in French Patent FR 2795433, contain hydrofluoric acid in considerable concentrations entail a significant safety and health risk owing to the high toxicity and corrosiveness of hydrofluoric acid, which escapes in gaseous form in considerable amounts from the electrolyte during the electropolishing process. The operation of electropolishing units with such electrolytes requires complicated safety precautions. In addition, the loss of hydrofluoric acid via the exhaust air must be regularly replenished in order to keep the electropolishing process stable.

The contacts of the workpieces to be electropolished in the abovementioned electrolytes must consist either of a material of the same type or of pure titanium. The contact material is equally attacked and must be regularly replaced. In view of the value of these metals, this constitutes a considerable cost factor and leads to premature wear of the electrolytes. Furthermore, it is thus not possible unambiguously to assign the current distribution and hence the respective ablation rates to the individual workpieces and the contact material. This constitutes an additional uncertainty factor where the accuracy of the electropolishing process has to meet high requirements. During the electropolishing, moreover, the workpieces must each be contacted solidly, for example by terminals, and cannot be processed loosely as bulk material in drums or baskets. In the case of parts of small mass, such as, for example, screws, this gives rise to considerable costs due to the necessary manual equipping of the contact racks.

It is an object of the invention to provide an electrolyte which is suitable for electropolishing titanium, titanium alloys, including nickel-titanium alloys (nitinol), niobium, niobium alloys, including niobium-zirconium alloys, and tantalum and tantalum alloys. In addition, it is intended to provide an electropolishing process that can be carried out easily and safely for such metals.

This object is achieved, according to the invention, by an electrolyte as claimed in claim 1 and a process as claimed in claim 6.

The electrolytes according to the invention consist of mixtures of sulfuric acid, ammonium bifluoride and at least one hydroxycarboxylic acid.

An advantage of the electrolytes according to the invention is that they are neither explosive nor flammable. In addition, they contain no hydrofluoric acid in excess which could escape in gaseous form as hydrogen fluoride during the electropolishing process, and cause no odor annoyance. Advantageously, a wide range of metals can be electropolished with the electrolytes according to the invention. These include titanium, titanium alloys, including nickel-titanium alloys, niobium, niobium alloys, including niobium-zirconium alloys, and tantalum and tantalum alloys. In particular, electrolytes according to the invention are suitable for electropolishing nitinol, which is a high-strength nickel-titanium alloy comprising 55% of Ni.

Depending on the materials to be electropolished, the electropolishing result can be optimized by changing the mixing ratio of the three components within certain concentration ranges.

Hydroxycarboxylic acids used are preferably hydroxylated $C_1$-$C_6$-carboxylic acids. The hydroxycarboxylic acids may be present in the electrolytes according to the invention in a concentration of 10-80% by volume, preferably 20-60% by volume. The preferred hydroxycarboxylic acids include glycolic acid and hydroxypropionic acid. The hydroxycarboxylic acids are preferably supplied as 60-80% solutions. It is also possible to use combinations of different hydroxycarboxylic acids.

An electrolyte according to the present invention may contain sulfuric acid in a concentration of 90-20% by volume, preferably 80-40% by volume. 96% sulfuric acid is preferably used.

The ammonium bifluoride can be used in the electrolytes according to the invention in a concentration of 10-150 g per liter, preferably 40-85 g per liter.

By using the electrolytes according to the invention, the corresponding metals can be efficiently and cleanly electropolished.

The invention also relates to a method for electrochemically polishing workpieces consisting of titanium, titanium alloys, niobium, niobium alloys, tantalum and tantalum alloys, in which method an electrolyte according to the invention is used.

An advantage of the method according to the invention is that the application parameters of the method can be varied within a wide range, which considerably facilitates the process control. In the prior art, on the other hand, the application parameters had to be kept within narrow limits. The method according to the invention is preferably used for polishing workpieces consisting of nickel-titanium alloys, such as, for example, nitinol, or niobium-zirconium alloys.

The method can be carried out at a temperature of from 0° C. to 40° C., an electrical DC voltage of from 10 V to 35 V and a current density of from 0.5 to 10 A/dm$^2$.

A further advantage of the present invention is that not only can the materials to be electropolished be used as contact material, but it is also possible to use aluminum, which is cheap to procure and is not attacked by the electropolishing process. It is thus possible unambiguously to assign the current density to the workpieces to be electropolished and hence to control the ablation within narrower tolerances. A further advantage of the method according to the invention is that free-flowing mass parts can be economically processed in aluminum drums or baskets as loose bulk material.

The invention is further explained with reference to the following examples.

EXAMPLE 1

Workpieces consisting of pure titanium were electropolished in an electrolyte consisting of

| | |
|---|---|
| glycolic acid (70%): | 20% by volume |
| sulfuric acid (96%): | 80% by volume |
| ammonium bifluoride: | 75 g/l |

with a current density of 1 A/dm$^2$ and in a processing time of 20 minutes. The result showed a very bright surface having good leveling of the microroughness.

EXAMPLE 2

Workpieces consisting of $TiAl_6V_4$, nitinol and niobium were electropolished in an electrolyte consisting of

| | |
|---|---|
| glycolic acid (70%): | 60% by volume |
| sulfuric acid (96%): | 40% by volume |
| ammonium bifluoride: | 50 g/l |

at temperatures of from 20° C. to 30° C. and current densities of from 1.5 to 5 A/dm$^2$. After an electropolishing time of 30 minutes throughout, all materials showed very bright surfaces and good smoothness.

The invention claimed is:

1. An electrolyte for electrochemically polishing workpieces consisting of titanium, titanium alloys, niobium, niobium alloys, tantalum and tantalum alloys, characterized in that it contains sulfuric acid, ammonium bifluoride and at least one hydroxycarboxylic acid.

2. The electrolyte as claimed in claim 1, wherein the hydroxycarboxylic acid used is glycolic acid or hydroxypropionic acid.

3. The electrolyte as claimed in claim 1, wherein it contains hydroxycarboxylic acids in a concentration of from 10 to 80% by volume, preferably 20-60% by volume.

4. The electrolyte as claimed in claim 1, wherein it contains sulfuric acid (96%) in a concentration of from 90 to 20% by volume, preferably 80-40% by volume.

5. The electrolyte as claimed in claim 1, wherein it contains ammonium bifluoride in a concentration of from 10 to 150 g per liter, preferably 40-85 g per liter.

6. A method comprising electrochemically polishing work-pieces consisting of titanium, titanium alloys, niobium, niobium alloys, tantalum or tantalum alloys, wherein the electrolyte as claimed in claim 1 is used.

7. The method as claimed in claim 6, wherein a nickel-titanium alloy or a niobium-zirconium alloy is used.

8. The method as claimed in claim 7, wherein a nickel-titanium alloy is nitinol.

9. The method as claimed in claim 6, wherein aluminum is used as contact material.

10. The method as claimed in claim 6, wherein the method is carried out at a temperature of from 0° C. to 40° C., an electrical DC voltage of from 10 V to 35 V and a current density of from 0.5 to 10 A/dm$^2$.

* * * * *